United States Patent [19]

O'Connor et al.

[11] Patent Number: 4,780,350

[45] Date of Patent: Oct. 25, 1988

[54] REINFORCING COMPOSITE FOR ROOFING MEMBRANES AND PROCESS FOR MAKING SUCH COMPOSITES

[75] Inventors: Terry J. O'Connor, Fonthill; Ian G. Cooper, St. Catharines, both of Canada

[73] Assignee: Bay Mills Limited, St. Catharines, Canada

[21] Appl. No.: 871,508

[22] Filed: Jun. 6, 1986

Related U.S. Application Data

[63] Continuation-in-part of Ser. No. 744,210, Jun. 13, 1985, abandoned.

[51] Int. Cl.[4] ..... B32B 5/12

[52] U.S. Cl. ..... 428/109; 28/169; 66/202; 156/148; 428/102; 428/247; 428/251; 428/253; 428/285; 428/287; 428/489

[58] Field of Search ..... 66/195, 190, 192, 202; 428/251, 252, 254, 489, 253, 247, 285, 287, 109, 102; 156/148; 28/169

[56] References Cited

U.S. PATENT DOCUMENTS

| | | | |
|---|---|---|---|
| 4,388,364 | 6/1983 | Sanders | 428/254 |
| 4,491,617 | 1/1985 | O'Connor et al. | 428/251 |
| 4,518,640 | 5/1985 | Wilkens | 428/254 |
| 4,540,311 | 9/1985 | Leach | 428/489 |
| 4,615,934 | 10/1986 | Ellison | 428/254 |

FOREIGN PATENT DOCUMENTS

| | | | |
|---|---|---|---|
| 2000937 | 7/1971 | Fed. Rep. of Germany | 428/254 |

OTHER PUBLICATIONS

J. Edward Lynn, "Advances in Textile Processing", vol. 1, 1961, p. 119.

*Primary Examiner*—James J. Bell

*Attorney, Agent, or Firm*—Fitzpatrick, Cella, Harper & Scinto

[57] ABSTRACT

A reinforcing composite for bituminous roofing membranes comprises a mechanically-fastened, open network of continuous filament, high tenacity polyester yarn. This structure is heat stabilized and may be combined with a fiberglass scrim and/or treated with a resin.

9 Claims, No Drawings

REINFORCING COMPOSITE FOR ROOFING MEMBRANES AND PROCESS FOR MAKING SUCH COMPOSITES

SUMMARY OF THE INVENTION

This is a continuation-in-part of application Ser. No. 744,210, filed June 13, 1985 now abandoned.

This invention relates to reinforcing composites for use in bituminous roofing membranes. Specifically, this invention relates to composites which utilize uniformly heat-stabilized, mechanically-fastened networks of high tenacity polyester yarn, either as the sole continuous filament reinforcing element or in combination with lightweight preformed mats, preferably polyester mats, mechanically fastened (for example, by knitting or stitching) to the open network of continuous filament polyester yarns. After heat-stabilization, thermosetting resins may be added to these composites. This invention also comprises processes for making such composites, heat stabilization of such composites, resin treatment of such composites, combinations of such composites with fiberglass scrim, and roofing membranes which incorporate such composites as a reinforcement. These composites are flexible, capable of being impregnated by bituminous material, and have sufficient strength to be useful in reinforcing roofing membranes.

DETAILED DESCRIPTION

1. Field of the Invention

In the manufacture of roofing membranes, a reinforcing sheet is saturated with bituminous material by leading the sheet through a tank or vat of bituminous material heated to about 275° to 425° F. (135° to 220° C.) using methods which are known in the art. The resulting combination is then rolled up for later installation, principally on flat roofs using additional bituminous material and/or a torch or other source of heat to seal the joints. The bituminous material used in making these membranes is often a "modified bitumen" such as asphalt combined with about 20% by weight of atactic polypropylene or 5 to 15% styrene butadiene rubber. This invention relates to a new form of polyester composite sheet for use in reinforcing such membranes.

2. Description of the Prior Art

Some of the various kinds of sheets used to reinforce bituminous roofing membranes are described in applicant's U.S. Pat. Nos. 4,491,617 and 4,539,254. Spunbonded, continuous filament polyester mats, including mats of polyester combined with other materials such as nylon, have been used as such reinforcements for many years. ("Mat" as used herein refers to an entangled mass of filaments.) In the prior art, these polyester mats have been heat stabilized to improve dimensional integrity and impregnated with resins to increase stiffness, but they have suffered from several disadvantages. These prior art mats are relatively thick and dense, typically having a weight of about 5 to 10.3 ounces per square yard (170 to 350 grams per square meter), and are difficult to saturate with bituminous material. Moreover, after saturation they become easier to tear and subject to stressing, stretching or other distortions which can lead to unevenness and other defects in the final roofing membrane. The filaments used in such mats are low tenacity polyester, which has contributed to their inability to withstand these stresses. In order to overcome this weakness, they have been made heavier, resulting in thicker, less porous composites, which are more difficult to saturate. Non-woven, high tenacity polyester networks, held together with thermoplastic adhesives and having yarn spacings of 2 to 8 yarns per inch, have sometimes been combined with polyester mats, but such networks (and combinations which include them) have not been completely successful.

With the present invention better properties, especially ease of saturation and improved finished tear strength, can be obtained, a thinner roofing membrane can be obtained, and lesser amounts of polyester may be used to achieve comparable results than was previously possible.

3. Description of the Invention

This invention comprises composites of heat-stabilized, mechanically-fastened networks of high tenacity continuous filament polyester yarns, either as the sole continuous filament reinforcing element or in combination with a mat and/or a fiberglass scrim. "Mechanically-fastened" indicates that the network is held together by mechanical means (e.g., by warp-knit weft-insertion techniques) rather than by forming a non-woven network held together by use of thermosetting or thermoplastic adhesives. It is preferred to heat stablize these composites before application of any thermosetting resins which may be added to improve stiffness or other properties of the composite, but such resins may be added before heat-stabilization if they are tack-free at heat-stabilization temperatures.

When a relatively high viscosity bituminous material is to be used in making the roofing membrane—i.e., a bituminous material sufficiently thick that the material fills the openings in the network—the heat-stabilized network may be impregnated with a thermosetting resin and used as the sole reinforcing element.

When a relatively low viscosity bituminous material is to be used, the composite may include a mat which enables the bituminous material to form a continuous sheet on the composite by providing coverage in the openings, or "windows", between the yarns of the open network. The mat of this invention preferably consists essentially of polyester filaments, though other synthetic mats such as mats of nylon or combinations of polyester and nylon, may be used. The mat is preformed, preferably spun-bonded, and relatively lightweight. By "lightweight" is meant a mat weighing about 0.3 to 4 ounces per square yard (10 to 140 grams per square meter), most preferably about 0.5 to 1.0 ounces per square yard (17 to 35 grams per square meter). By "preformed" is meant a mat which has been fabricated into the mat form before it is combined with the open network. In this invention the mat may be mechanically fastened to the open network at the time the open network is made, the network being an open grid having yarns which cross each other in substantially perpendicular directions and preferably being non-woven. For example, this invention comprises composites made of lightweight polyester mat knitted into a warp-knit, weft-inserted polyester structure, such as may be made using a LIBA Copcentra or Malimo warp knitting machine with full width weft insertion. Alternatively, the mat may be stitched to the open network.

With some bituminous materials the heat-stabilized network, without later impregnation with a thermosetting resin, may (a) be led with a fiberglass mat, as two separate components, through a vat of bituminous material to create a single roofing membrane sheet, or (b)

may be laminated to a fiberglass scrim and led through a vat of bituminous material to make a roofing membrane.

The continuous filament polyester yarn open network structure preferably consists of high tenacity polyester warp and weft yarns of about 220 to 2000 denier, and most preferably about 1000 denier, knitted together at about 3 to 18 yarns per inch (1 to 7 yarns per centimeter), preferably at 6 to 9 yarns per inch (2 to 3.5 yarns per centimeter), with a knit, or sewing, yarn of about 40 to 500 denier (preferably of about 70 denier regular tenacity) polyester yarn. The knit, or stitch, may be tricot, chain or other stitch, but preferably chain stitch. The weight of the entire composite (mat mechanically fastened to the open network) may range from about 1.0 ounces per square yard (34 grams per square meter) to about 6.0 ounces per square yard (205 grams per square meter), preferably about 2 to 4 ounces per square yard (68 to 140 grams per square meter).

This composite of continuous filament polyester open network alone, or of network mechanically fastened to a mat, results in a reinforcement which has dimensional integrity with uniform coverage of interstices in the structure. The composite can be readily and thoroughly saturated with modified asphalts or other bituminous material on roll roofing manufacturing lines and has several other advantages. For example, approximately equal tensile strengths can be achieved at one-half the weight of polyester and one-half the thickness, because the continuous filament polyester yarn has more than twice the tenacity of polyester filaments in a spunbonded mat.

This results in a thinner and more porous reinforcing composite, which is important for several reasons. Such a reinforcing composite can be saturated with bituminous material more easily than a thick, dense one, and less bituminous material is required. Saturation of the mat (that is to say, thoroughly impregnating the mat and coating individual fibers so that fibers are isolated from adjacent fibers) is highly important in the manufacture of roofing membranes. To insure thorough saturation, some manufacturers have first saturated prior art mats with a low viscosity bituminous mixture, followed by a second application of a high viscosity bituminous mixture, but that two-step procedure is not necessary with the composite of this invention.

With the reinforcing composite of this invention, there is also less danger that part of the reinforcement will be near the surface of the membrane and be burnt, or "torched," while the membrane is being installed on a roof. Also, the reinforcing composite of this invention can be more readily heat stabilized at high temperatures without adversely affecting its properties.

Heat stabilization of the composite may be accomplished by subjecting the composite to heat treatment, for example by passing the composite through an oven while conditions such as temperature, tension, and dwell-time at high temperature are controlled to achieve minimal shrinkage in the machine and cross-machine directions at temperatures used in saturating with bituminous material. It is preferred to use temperatures up to about 460° F. (238° C.) and preferably to control the tension and dwell-time to result in shrinkage during the heat stabilization step of 5% to 10%, with the resulting composite having a free shrinkage (i.e., residual shrinkage) of less than 2% and preferably less than 1% in both machine and cross-machine directions as a result of the combination of heat setting and heat relaxation which occurs under these conditions. In making the measurement of free shrinkage, it is preferred to cut ten strips of fabric ten inches long by one inch wide. Five are cut in the machine direction and five in the cross-machine direction at positions selected from across the width of the structure. These strips are placed vertically in an oven under light tension just sufficient to keep them straight. The shrinkage of each set of five samples is measured after five minutes at 400° F. (222° C.) and the results are averaged. If the average shrinkage is too great (greater than two percent or preferably one percent) in either direction, the composite is run through the heat stabilization treatment again at higher temperature, or slower speed, or less tension, until the desired level of free shrinkage is reached. We have found that composites of high tenacity polyester yarns heat-stabilized as described retain their desirable properties, such as strength, and also retain their shape in bituminous impregnated roofing membranes.

The mechanically fastened knit or sewn structure of this invention may be laminated to a fiberglass scrim preferably of 37 1/0 to 150 1/0 yarns, or more preferably 75 1/0 to 150 1/0, with about 2 yarns per inch (0.8 yarns per centimeter) held together with an adhesive. Scrims made of yarns as heavy as about 18 1/0 may be used and the number of yarns per inch may range from about 1 to 10 (0.4 to 4 yarns per centimeter). Fiberglass scrim may provide additional strength, higher modulus and other desirable properties, particularly during manufacture of the roofing membrane when the heat of processing causes the polyester to lose strength.

This lamination of fiberglass scrims to polyester composite may be accomplished by one of-the following exemplary methods:

(a) using a fiberglass scrim bonded with a thermosetting adhesive (such as 5 to 10% by weight of polyvinyl alcohol or 5 to 75% by weight of cross-linking acrylic or styrene-butadiene latex) and laminating it to the polyester composite by dipping the polyester composite in a cross-linking acrylic latex, marrying the fiberglass scrim to the wet polyester composite, and drying and curing in contact with heated steel drums, (b) using a fiberglass scrim bonded with a thermosetting adhesive (such as 5 to 10% by weight of polyvinyl alcohol or 5 to 75% by weight of cross-linking acrylic or styrene-butadiene latex), carrying this scrim together with the polyester composite through a saturating bath of cross-linking acrylic latex, and taking them over heated steel drums to dry and cure, (c) by using a fiberglass scrim bonded with a thermosetting adhesive (such as 5 to 75% by weight of cross-linking acrylic or styrene-butadiene latex) and laminating it to a resin-impregnated, heat-stabilized composite made from a network of adhesive-free, high tenacity continuous filament polyester yarns as follows: (i) the fiberglass scrim is dipped in polyvinyl alcohol, (ii) the wet fiberglass scrim is married to the polyester network, and (iii) the resulting combination is dried in contact with heated steel drums, or (d) by reactivating a thermoplastic adhesive (such as 50% by weight of polyvinyl chloride latex or similar thermoplastic adhesive) on the fiberglass scrim and heat-sealing or hot-nipping the scrim to the composite by means of a steel-on-rubber roll nip.

A detailed description of these procedures is set forth in applicant's patents identified above. The words "thermosetting adhesive" are used herein to mean a thermosetting adhesive which maintains its bonding ability up to about 425° F., that is to say, a thermosetting adhesive which is not tacky at about 425° F. In accordance with this definition, it will be understood that some thermosetting adhesives, if partially cured, may act as thermoplastic adhesives.

The weight of the fiberglass scrim is preferably a small fraction of the weight of the polyester composite structure, and the laminating procedure must be carefully controlled with respect to tension in order to avoid placing tensile stresses on the polyester structure. As already mentioned, polyester has a relatively low modulus at high temperatures, and stresses can be induced easily which may result in dimensional distortion and consequential defects in the final roofing membrane.

Resins, by which is meant chemicals that increase stiffness, provide water resistance, or otherwise improve properties of the polyester composite or the properties of the final roofing membrane, may be added to the network, the composite of mat and open network, or the combination of those structures with fiberglass scrim. Some resins can also serve the functions of adhesives described above. Resins are added by thoroughly saturating the composite at an add-on rate of about 5 to 100 parts of resin per 100 parts by weight of composite but preferably with about 10 to 20 parts of resin.

The resin is typically a cross-linked acrylic resin but may be any resinous material which is unaffected by water and retains its bonding properties up to temperatures used in making roofing membranes. For finished roofing membranes containing a polyester composite or a polyester/fiberglass combination as a reinforcement, both the amount of resin added and the stiffness of the resin may be adjusted to achieve desired properties. For example, when the final roofing membrane is to be thick, stiffer reinforcements may be required to help processing through the production line. Also, a stiffer reinforcement is required for low modulus asphalt membranes to facilitate handling during installation on the roof, and also to improve roll integrity and minimize damage in transit.

The following examples will illustrate the invention.

EXAMPLE 1

Using a LIBA Copcentra machine, a spun-bonded polyester mat weighing 0.5 oz/sq yd was knitted into a polyester knit structure having 9 yarns per inch in the machine direction and 9 yarns per inch in the weft direction of 1000 denier high tenacity polyester yarn. The knitting yarn used was 70 denier regular tenacity polyester yarn. A chain stitch was used with the 70 denier yarn spaced at 9 stitches/inch over each 1000 denier warp yarn and forming a full stitch between each 1000 denier weft yarn. This polyester structure weighed 3.25 oz/sq yd.

The polyester structure was heat stabilized by unrolling it and feeding over a series of preheated rolls at 450° F., then through a heated nip at 450° F., under tension which was controlled to result in an overfeed into the heating section of 5%. Dwell-time was adjusted until the finished fabric had 1% or less of free shrinkage, in both the machine and cross machine direction when tested at 400° F. for five minutes as set forth above.

The heat stabilized polyester structure was in turn saturated with 20 parts (per 100 parts by weight of composite) of a black-tinted cross-linking acrylic latex resin saturant consisting of Rohm & Haas Rhoplex HA16 (92 parts by weight per 100 parts of the solids content of the saturant), Cymel 303 cross-linking agent (4.4 parts), black pigment (2.8 parts) and ammonium nitrate as a catalyst (0.8 parts) in water (in the proportion of 28% by weight of solids to 72% by weight of water), and the composite was dried and cured. Conditions of tension, speed, solids content of the saturant, and pressure used to squeeze off excess saturant were adjusted such that the acrylic latex resin penetrated the polyester fiber bundles and the finished surface remained porous, i.e. the acrylic latex resin did not form a surface film on the structure or yarns. The resulting structure was suitable for use as a reinforcing composite for roofing membranes.

EXAMPLE 2

Using a LIBA Copcentra machine, a network of adhesive-free, 1000 denier high tenacity continuous filament polyester yarn of the kind used in making tires was knit into a structure having 9 yarns per inch in the machine direction and 9 yarns per inch in the weft direction. The knitting yarn used was 70 denier regular tenacity yarn. A chain stitch was used with the 70 denier yarn spaced at 9 stitches/inch over each 1000 denier warp yarn and forming a full stitch between each 1000 denier weft yarn to create a structure weighing 3.25 oz/sq. yd.

This structure was heat stabilized following the procedure of Example 1 and then impregnated with the acrylic latex composition of Example 1, again following the procedure of Example 1. The resulting composite was suitable for use as a reinforcing composite for roofing membranes.

EXAMPLE 3

Using a LIBA Copcentra machine, a spun-bonded polyester mat weighing 0 5 oz/sq yd was knitted into a polyester knit structure having 6 yarns per inch in the machine direction and 6 yarns per inch in the weft direction of 1000 denier high tenacity polyester yarn. The knitting yarn used was 70 denier regular tenacity polyester yarn. A chain stitch was used to combine the structure with 70 denier yarn spaced at 6 stitches/inch over each 1000 denier warp yarn and forming a full stitch between each 1000 denier weft yarn. This polyester structure weighed 2.35 oz/sq yd.

The polyester structure was heat stabilized by unrolling it and feeding over a series of preheated rolls at 450° F., then through a heated nip at 450° F., under tension which was controlled to result in an overfeed into the heating section of 5%. Conditions were adjusted until the finished fabric had 1% or less of free shrinkage in both the machine and cross machine directions when tested at 400° F. for five minutes as set forth above.

The heat stabilized polyester structure was then combined with a fiberglass scrim having 2 yarns per inch in both the machine and cross machine directions of 75 1/0 fiberglass yarns coated with 50 parts of PVC latex (per 100 parts of fiberglass yarn). This combination was achieved by unwinding both the polyester structure and the fiberglass scrim, feeding them together over a preheat roll at 350° F., then through a heated nip 380° F. at 150 pounds per linear inch (PLI).

This structure was in turn saturated with 20 parts (per 100 parts by weight of composite) of the black-tinted cross-linking acrylic latex resin used in Example 1 and the composite was dried and cured. Conditions of tension, speed, solids content of the saturant, and pressure used to squeeze off excess saturant were adjusted such that the acrylic latex penetrated the polyester fiber bundles and the finished surface remained porous, i.e. the acrylic latex did not form a surface film. The resulting structure was suitable for use as a reinforcing composite for roofing membranes.

EXAMPLE 4

A spun-bonded polyester mat weighing 1 oz/sq yd may be knitted into a polyester structure using a Malimo machine having 7 yarns per inch in the machine direction and 7 yarns per inch essentially perpendicular to the machine direction of 1000 denier high tenacity polyester yarn. The knitting yarn used may be 70 denier regular tenacity polyester yarn. A chain stitch may be used to combine the structure with 70 denier yarn spaced at 7 stitches/inch over each 1000 denier machine direction yarn and forming a full stitch at each 1000 denier cross direction yarn. This polyester structure weighs 3.15 oz/sq yd.

The structure is in turn coated with 20 parts (per 100 parts by weight of composite) of a black-tinted cross-linking acrylic latex resin and the composite is dried and cured. Conditions of tension, speed, solids content of the saturant, and pressure used to squeeze off excess saturant are adjusted such that the acrylic latex penetrates the polyester fiber bundles, and the finished surface remains porous, i.e. that the acrylic latex does not form a surface film.

The above resin treated polyester structure is then heat stabilized by unrolling it and feeding over a series of preheated rolls at 450° F., then through a heated nip at 450° F. under controlled tension. Conditions are adjusted as described above until the finished fabric has 1% or less of free shrinkage in both the machine and cross-machine directions, when tested at 400° F. for five minutes. The resulting structure is suitable for use as a reinforcing composite for roofing membranes.

We claim:

1. A composite for reinforcing roofing membranes comprising a fiberglass scrim combined with a lightweight preformed synthetic mat mechanically fastened by knitting to an open network of continuous filament polyester yarn wherein the composite is heat-stable, flexible, capable of being impregnated by nituminous material, and of sufficient strength to be useful in reinforcing such membranes.

2. A composite impregnated with a thermosetting resin for reinforcing roofing membranes comprising a lightweight preformed synthetic mat mechanically fastened by knitting to an open network of continuous filament polyester yarn wherein the composite is heat-shrink, flexible, capable of being impregnated by bituminous material, and of sufficient strength to be useful in reinforcing such membranes.

3. The composite of claim 1 in which the composite is impregnated with a thermosetting resin.

4. The composite of claim 2 in which the resin impregnation occurs before heat shrinking of the composite.

5. The composite of claim 4 in which the composite is combined with a fiberglass scrim.

6. A process for making a composite for use in reinforcing roofing membranes comprising the steps of:

selecting a lightweight preformed synthetic mat, mechanically fastening by knitting said mat to an open network of continuous filament polyester yarn structure, heat shrinking the resulting composite, and combining the composite with a fiberglass scrim, wherein the resulting composite is flexible, capable of being impregnated by bituminous material, and of sufficient strength to be useful in reinforcing roofing membranes.

7. A process for making a composite for use in reinforcing roofing membranes comprising the steps of:

selecting a lightweight preformed synthetic mat, mechanically fastening by knitting said mat to an open network of continuous filament polyester yarn structure, heat shrinking the resulting composite, and impregnating the composite with a thermosetting resin, wherein the resulting composite is flexible, capable of being impregnated by bituminous material, and of sufficient strength to be useful in reinforcing roofing membranes.

8. The process of claim 6 comprising the additional step of impregnating the composite with a thermosetting resin.

9. The process of claim 8 wherein resin treatment occurs before heat shrinking.

* * * * *